US009268352B2

(12) United States Patent
Fan

(10) Patent No.: US 9,268,352 B2
(45) Date of Patent: Feb. 23, 2016

(54) CIRCUIT FOR OUTPUTTING REFERENCE VOLTAGE

(71) Applicant: IPGoal Microelectronics (Sichuan) Co., Ltd., Chengdu, Sichuan (CN)

(72) Inventor: Fangping Fan, Sichuan (CN)

(73) Assignee: IPGoal Microelectronics (Sichuan) Co., Ltd., Chengdu, Sichuan (CN)

( * ) Notice: Subject to any disclaimer, the term of this patent is extended or adjusted under 35 U.S.C. 154(b) by 204 days.

(21) Appl. No.: 14/063,223

(22) Filed: Oct. 25, 2013

(65) Prior Publication Data

US 2014/0176113 A1 Jun. 26, 2014

(30) Foreign Application Priority Data

Oct. 25, 2012 (CN) ..... 2012 1 0411734

(51) Int. Cl.
*G05F 3/24* (2006.01)
*G05F 3/30* (2006.01)

(52) U.S. Cl.
CPC .. *G05F 3/242* (2013.01); *G05F 3/30* (2013.01)

(58) Field of Classification Search
CPC ..... G05F 3/16; G05F 3/20; G05F 3/24; G05F 3/242; G05F 3/262; G05F 3/30
USPC ..... 323/316
See application file for complete search history.

(56) References Cited

U.S. PATENT DOCUMENTS

| | | | | |
|---|---|---|---|---|
| 7,301,321 | B1 * | 11/2007 | Uang et al. | 323/313 |
| 7,609,046 | B2 * | 10/2009 | Wada et al. | 323/316 |
| 7,902,912 | B2 * | 3/2011 | Marinca | 327/539 |
| 8,207,787 | B2 * | 6/2012 | Hasegawa et al. | 327/543 |
| 2004/0124825 | A1 * | 7/2004 | Marinca | 323/316 |
| 2006/0071703 | A1 * | 4/2006 | Chatterjee et al. | 327/534 |
| 2010/0156386 | A1 * | 6/2010 | Imura | 323/313 |
| 2013/0328621 | A1 * | 12/2013 | Kim | 327/543 |

* cited by examiner

*Primary Examiner* — Fred E Finch, III

(57) ABSTRACT

A circuit for outputting reference voltage includes: a detecting unit, a feedback unit and an output unit which are respectively connected with an external power source, wherein a plurality of field effect transistors (FETs) are provided in the detecting unit, wherein the detecting unit is for detecting foundry corners of the FETs therein, the feedback unit is for feeding back and comparing a detecting result of the detecting unit, and outputting information after feeding back and comparing, and the output unit is for outputting reference voltage corresponding to the foundry corners of the FETs to an external output terminal. The reference voltage outputted by the circuit for outputting reference voltage of the present invention is capable of varying with foundry corners of the FETs, and achieves compensating for foundry corners of the FETs.

6 Claims, 2 Drawing Sheets

CIRCUIT FOR OUTPUTTING REFERENCE VOLTAGE

BACKGROUND OF THE PRESENT INVENTION

1. Field of Invention

The present invention relates to the field of an integrated circuit, and more particularly to a circuit for outputting reference voltage.

2. Description of Related Arts

The circuit for outputting reference voltage is mainly used for providing a stable voltage outputted, and the voltage outputted thereof serves as a reference for other circuits. The circuit for outputting reference voltage has characteristics of having temperature compensation, little affection by power source and temperature, high precision and etc., and thus is widely applied in structures of various circuits.

As is well known, the circuit for outputting reference voltage comprises a plurality of field effect transistors (FETs). However, the output voltage of the circuit for outputting reference voltage usually is not varying with foundry corner of the FETs; while in some special circuits such as oscillator, because the foundry corner of the FETs has a great effect on the frequency of the oscillator, it is usually necessary for compensating the foundry corner, so as to output a constant frequency thereby. In this situation, the conventional circuits for outputting reference voltage are not capable of meeting the requirements. Therefore, it is necessary to provide a circuit for outputting reference voltage having output voltage capable of varying with the foundry corner of the FETs. Furthermore, in order to avoid the output voltage from being affected by temperature, the circuit should have temperature compensation as well. In addition, the foundry corner of the FETs refers to parameter variation of the FETs in the manufacture process of the FETs due to position differences on one wafer, or between wafers of different batches.

SUMMARY OF THE PRESENT INVENTION

An object of the present invention is to provide a circuit for outputting reference voltage which is capable of varying with foundry corner of field effect transistors (FETs), and achieves compensating the foundry corner of the FETs.

Accordingly, in order to accomplish the above objects, the present invention provides a circuit for outputting reference voltage comprising:

A circuit for outputting reference voltage, comprises:

a detecting unit, a feedback unit and an output unit which are respectively connected with an external power source, wherein a plurality of field effect transistors (FETs) are provided in the detecting unit, wherein the detecting unit is for detecting foundry corners of the FETs therein, the feedback unit is for feeding back and comparing a detecting result of the detecting unit, and outputting information after feeding back and comparing, and the output unit is for outputting reference voltage corresponding to the foundry corners of the FETs to an external output terminal Preferably, the detecting unit comprises a first FET, a second FET, a third FET and a fourth FET, wherein a gate electrode and a drain electrode of the first FET are grounded, a source electrode of the first FET is connected with a drain electrode of the third FET, a source electrode of the second FET is connected with a drain electrode of the fourth FET, a drain electrode of the second FET is grounded, a gate electrode of the third FET is connected with a gate electrode of the fourth FET, and both a source electrode of the third FET and a source electrode of the fourth FET are connected with the external power source.

Preferably, the feedback unit comprises a first resistor, a fifth FET, a sixth FET and a comparator, wherein a first end of the first resistor is grounded, and a second end thereof is connected with a gate electrode of the second FET, an inverted end of the comparator is connected with a source electrode of the second FET and a drain electrode of the fourth FET, a positive going input end of the comparator is connected with a drain electrode of the third FET and a source electrode of the first FET, a gate electrode and a drain electrode of the fifth FET, a gate electrode of the fourth FET and a drain electrode of the sixth FET are all connected, a source electrode of the fifth FET is connected with the external power source, a gate electrode of the sixth FET is connected with an output terminal of the comparator, and a source electrode of the sixth FET is connected with a gate electrode of the second FET.

Preferably, the output unit comprises a seventh FET, a second resistor and an eighth FET, wherein a gate electrode of the seventh FET is connected with a drain electrode and a gate electrode of the fifth FET and a drain electrode of the sixth FET, a source electrode of the seventh FET is connected with the external power source, a drain electrode of the seventh FET is connected with a first end of the second resistor and the external output terminal, a second end of the second resistor is connected with a source electrode of the eighth FET, and both a drain electrode and a gate electrode of the eighth FET are grounded.

Preferably, the first FET, the second FET and the eighth FET have the same channel-length and the same threshold voltage.

Preferably, the first FET and the second FET have the same channel-width, and a channel-width of eighth FET is k times thereof the first FET or the second FET, wherein k is a positive integer.

Preferably, the fourth FET, the fifth FET and the seventh FET have the same breadth length ratio, a breadth length ratio of the third FET is twice as much as thereof the fourth FET, the fifth FET or the seventh FET.

Preferably, the first FET, the second FET, the third FET, the fourth FET, the fifth FET, the seventh FET and the eighth FET all have the same electron mobility and gate oxide capacitance per unit area.

Compared with the prior art, in the circuit for outputting reference voltage of the present invention, the detecting unit detects the foundry corner of the FETs thereof, the feedback unit processes feeding back and comparing a detecting result of the detecting unit, and outputting information after feeding back and comparing, the output unit outputs reference voltage corresponding to the foundry corners of the FETs to an external output terminal, in such a manner that the reference voltage outputted thereby reflects information of the foundry corners of the FETs, i.e., the reference voltage is capable of varying with the foundry corners of the FETs, so as to achieve compensating for the foundry corner of the FETs. Furthermore, the reference voltage outputted thereof has temperature compensation and is little affected by temperature.

These and other objectives, features, and advantages of the present invention will become apparent from the following detailed description, the accompanying drawings, and the appended claims.

DETAILED DESCRIPTION OF THE PREFERRED EMBODIMENT

Preferred embodiments of the present invention are illustrated combining with the drawings, wherein similar element symbols represent similar elements. As mentioned above, the present invention provides a circuit for outputting reference voltage, wherein the reference voltage outputted thereof is capable of varying with foundry corners of FETs, so as to achieve compensating for the foundry corners of the FETs.

Figure 1:
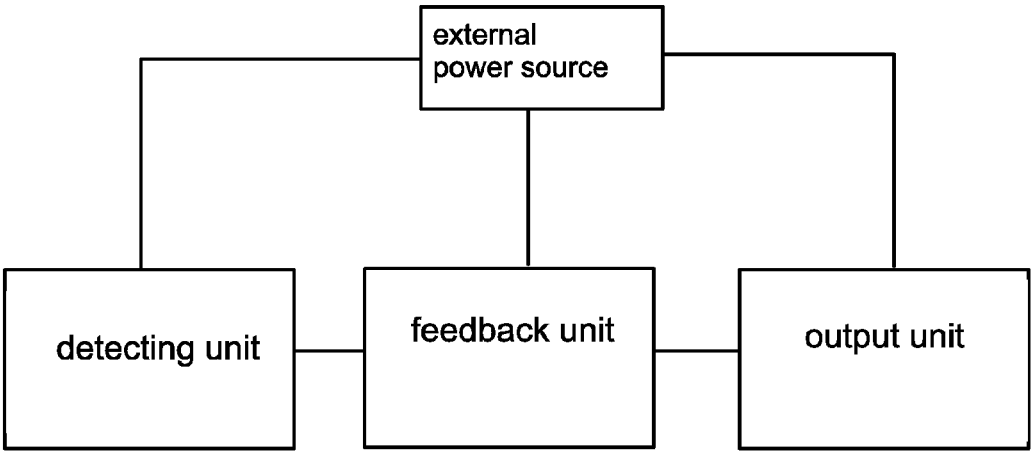
FIG. 1 is a structural block diagram of a circuit for outputting reference voltage according to a preferred embodiment of the present invention.

Referring to FIG. 1, FIG. 1 is a structural block diagram of a circuit for outputting reference voltage according to a preferred embodiment of the present invention. As shown in FIG. 1, the circuit for outputting reference voltage comprises a detecting unit, a feedback unit and an output unit which are respectively connected with an external power source, wherein the detecting unit is for detecting foundry corners of the FETs therein and conveying detecting results thereof to the feedback unit, the feedback unit is for feeding back and comparing a detecting result of the detecting unit, and outputting information after feeding back and comparing to the output unit, and the output unit is for outputting reference voltage corresponding to the foundry corners of the FETs to an external output terminal, and meanwhile for processing temperature compensation on the reference voltage outputted thereof.

Figure 2:
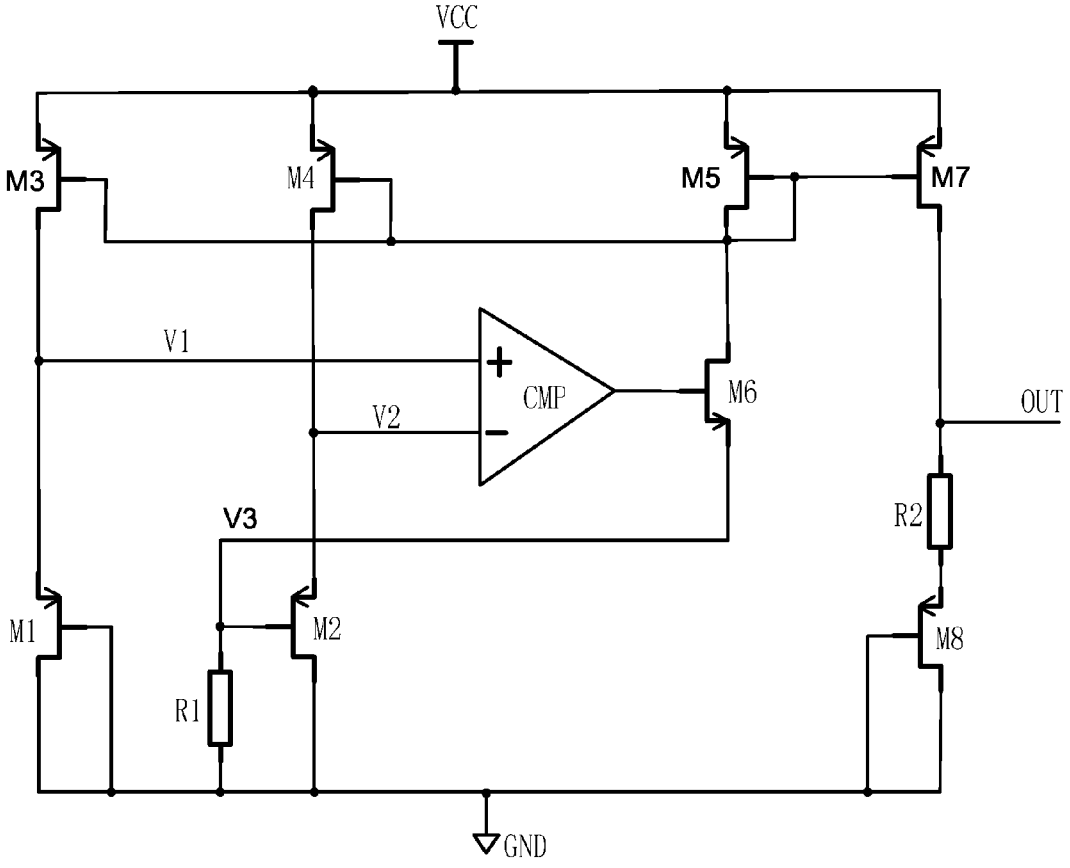
FIG. 2 is a schematic circuit diagram of the circuit for outputting reference voltage according to the preferred embodiment of the present invention.

Specifically, further referring to FIG. 2 of the drawings, FIG. 2 is a schematic circuit diagram of the circuit for outputting reference voltage according to the preferred embodiment of the present invention, wherein the external power source is an external direct-current power source VCC.

The detecting circuit comprises a first FET M1, a second FET M2, a third FET M3 and a fourth FET M4, wherein a gate electrode and a drain electrode of the first FET M1, and a drain electrode of the second FET M2 are all connected with an earth terminal GND, both a source electrode of the third FET M3 and a source electrode of the fourth FET M4 are connected with the external power source VCC, a source electrode of the first FET M1 is connected with a drain electrode of the third FET M3, and a voltage between the source electrode of the first FET M1 and the drain electrode of the third FET M3 is defined as V1, a source electrode of the second FET M2 is connected with a drain electrode of the fourth FET M4, and a voltage between the source electrode of the second FET M2 and the drain electrode of the fourth FET M4 is defined as V2, and a gate electrode of the second FET M2 is defined as V3, wherein the third FET M3 supplies the first FET M1 with a bias current, the fourth FET M4 supplies the second FET M2 with a bias current, in such a manner that the first FET M1 and the second FET M2 generate two different gate-source voltages;

wherein a gate-source voltage of the first FET M1 is V1 (the gate electrode of the first FET M1 is grounded), and a gate-source voltage of the second FET M2 is V2-V3.

The feedback unit comprises a fifth FET M5, a sixth FET M6, a first resistor R1 and a comparator CMP;

wherein a gate electrode of the second FET M2 is connected with a first terminal of the first resistor R1, a gate electrode and a drain electrode of the fifth FET M5, and a drain electrode of the sixth FET M6 are all connected with a gate electrode of the fourth FET M4 and a gate electrode of the third FET M3, a source electrode of the fifth FET M5 is connected with the external power source VCC, a gate electrode of the six FET M6 is connected with an output terminal of the comparator CMP, a source electrode of the sixth FET M6 is connected with a first end of the first resistor R1, and a second end of the first resistor R1 is connected with an earth terminal GND, wherein the first resistor R1 converts the voltage V3 to a current, so as to supply the third FET M3 and the fourth FET M4 with a bias current via the comparator CMP and the sixth FET M6;

the sixth FET M6 and the comparator CMP forces V1 and V2 to have a same voltage value, the fifth FET M5 is for supply the first FET M1 and the second FET M2 with the current generated by the first resistor R1 according to a scale size preset;

a positive going input end of the first comparator CMP is respectively connected with a drain electrode of the third FET M3 and a source electrode of the first FET M1.

Thus, by the feedback unit, V1 equals to V2, so V3 is a difference of gate-source voltage of the first FET M1 and the second FET M2. Understandably, the difference of gate-source voltage includes information of foundry corners of the FETs, i.e., the detecting unit is for detecting foundry corners of the first FET M1 and the second FET M2, and the voltage V3 also contains foundry corner information of the first FET M1 and the second FET M2.

The output unit comprises a seventh FET M7, a second resistor R2 and an eighth FET M8, wherein a gate electrode of the seventh FET M7 is connected with a drain electrode of the sixth FET M6 and a gate electrode of the fifth FET M5, in such a manner that the sixth FET M6 outputs the current generated by the first resistor R1 to the seventh FET M7 according to a scale preset, i.e., a current passing through the seventh FET M7 contains information of foundry corner, a source electrode of the seventh FET M7 is connected with the external power source VCC, both a drain electrode of the seventh FET M7 and a first end of the second resistor R2 are connected with an external output terminal OUT;

a second end of the second resistor R2 is connected with a source electrode of the eighth FET M8, both a drain electrode and a gate electrode of the eighth FET M8 are connected with the earth terminal GND, The seventh FET M7 supplies the eighth FET M8 with a bias current, the second resistor R2 converts the current supplied by the seventh FET M7 to a voltage and meanwhile offsets effects brought by foundry corners of the first resistor R1 and the second resistor R2. The eighth FET M8 supplies a threshold voltage, and meanwhile converts the current supplies by the seventh FET M7 to a voltage, which is added to the voltage generated by the second resistor, so as to generate and output a reference voltage, and the reference voltage is outputted by the external output terminal OUT.

According to another preferred embodiment of the present invention, the first FET, the second FET and the eighth FET have the same channel-length and the same threshold voltage. The first FET and the second FET have the same channel-width, and a channel-width of eighth FET is k times thereof the first FET or the second FET, wherein k is a positive integer. Preferably, The fourth FET, the fifth FET and the seventh FET have the same breadth length ratio, a breadth length ratio of the third FET is twice as much as thereof the fourth FET, the fifth FET or the seventh FET.

Working principle of the circuit for outputting reference voltage of the present invention is as follows. Referring to FIG. 2 of the drawings, a reference voltage outputted by the external output terminal OUT is defined as VREF. A channel-length of the first FET M1 is defined as L1, a channel-length of the second FET M2 is defined as L2, and a channel-length of the eighth FET M8 is defined as L8, i.e., L1=L2=L8. A channel-width of the first FET M1 is defined as W1, and a channel-width of the second FET M2 is defined as W2, i.e., W1=W2. A channel-width of the eighth FET M8 is defined as W8, so k*W2=k*W1=W8, wherein k is a positive integer. A threshold voltage of the first FET M1, the second FET M2 and the eighth FET M8 is defined as $V_{TH}$. A breadth length ratio of the third FET M3 is defined as $(W/L)_3$, a breadth length ratio of the fourth FET M4 is defined as $(W/L)_4$, a breadth length ratio of the fifth FET M5 is defined as $(W/L)_5$, a breadth length ratio of the seventh FET M7 is defined as $(W/L)_7$, i.e., breadth length ratios of the third FET M3, the fourth FET M4, the fifth FET M5 and the seventh FET M7 are respectively $0.5*(W/L)_3=(W/L)_4=(W/L)_5=(W/L)_7$. Currents passing trough the first resistor R1 is defined as IR, $0.5*(W/L)_3=(W/L)_4=(W/L)_5=(W/L)_7$, so currents passing through the third FET M3, the fourth FET M4, the fifth FET M5 and the seventh FET M7 are respectively 2*IR. IR. IR and IR. Up is defined as electron mobility of all the FETs mentioned above (except the sixth FET M6). Cox is defined as gate oxide capacitance per unit area of all of the FETs mentioned above (except the sixth FET M6).

The gate-source voltage of the first FET M1 is $V_{GS1}$, $$V_{GS1} = V1 = V2 = V_{TH} + \sqrt{\frac{4*IR}{up*Cox*(W/L)_1}}.$$

The gate-source voltage of the second FET M2 is $V_{GS2}$, $$V_{GS2} = V2 - V3 = V_{GS1} - V3 = V_{TH} + \sqrt{\frac{2*IR}{up*Cox*(W/L)_2}} \quad (1)$$

Since V3=IR*R1, the expression (1) turn into the following expression:

$$V_{TH} + \sqrt{\frac{4*IR}{up*Cox*(W/L)_1}} - IR*R1 = V_{TH} + \sqrt{\frac{2*IR}{up*Cox*(W/L)_2}}, \quad (2)$$

further because $(W/L)_1=(W/L)_2$, a solution from the expression (2) is:

$$IR = \frac{2*(\sqrt{2}-1)^2}{up*Cox*(W/L)_1*R1^2}.$$

Because VREF=IR*R2+$V_{GS8}$, $$VREF = V_{TH} + \frac{2*(\sqrt{2}-1)^2}{up*Cox*(W/L)_1*R1^2}*R2 + \sqrt{\frac{2*IR}{up*Cox*(W/L)_8}} \quad (3)$$

$$\text{If } (W/L)_8 = k*(W/L)_1$$

$$VREF = V_{TH} + \frac{2-\sqrt{2}}{up*Cox*(W/L)_1*R1}*\left(\frac{(2-\sqrt{2})*R2}{R1} + \frac{1}{k}\right)$$

$$\text{if } \beta = \frac{2-\sqrt{2}}{(W/L)_1*R1}*\left(\frac{(2-\sqrt{2})*R2}{R1} + \frac{1}{k}\right),$$

the expression (3) turns into following expression:

$$VREF = V_{TH} + \frac{\beta}{up*Cox} \quad (4)$$

As is well known, the electron mobility has high-order negative temperature characteristic, up in the present invention has high-order negative temperature characteristic. In the expression (4), β/(Cox*up) has high-order positive temperature characteristic, and threshold voltage of each FET has first-order negative temperature characteristic, i.e., in the present invention, VTH is a parameter having first-order negative temperature characteristic, so the reference voltage VREF outputted thereof has first-order temperature compensation. In addition, both VTH and Cox are parameters related to foundry corners of FETs, and when the FETs are distributed in slow foundry corners, VTH turns larger, and Cox turns smaller, i.e., β/(Cox*up) turns larger as well, so VREF turns larger. Otherwise, when the FETs are in quick foundry corner, VTH becomes smaller, and Cox becomes larger, i.e, β/(Cox*up) becomes smaller as well, so VREF becomes smaller. Thus, the reference voltage VREF outputted by the circuit for outputting reference voltage of the present invention finally reflects the foundry corners of the first FET Ml and the second FET M2.

In summary, the circuit for outputting reference voltage of the present invention not only varies with the foundry corner of the FETs, reflects the foundry corner of the FETs, but also processes temperature compensation for the voltage VREF outputted by the output terminal OUT, in such a manner that the reference voltage VREF outputted by the output terminal OUT is not affected by temperature.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A circuit for outputting reference voltage, comprising: a detecting unit, a feedback unit and an output unit which are respectively connected with an external power source, wherein a plurality of field effect transistors (FETs) are provided in the detecting unit, wherein the detecting unit is for detecting foundry corners of the FETs therein, the feedback unit is for feeding back and comparing a detecting result of the detecting unit, and outputting information after feeding back and comparing, and the output unit is for outputting reference voltage corresponding to the foundry corners of the FETs to an external output terminal;

wherein the detecting unit comprises a first FET, a second FET, a third FET and a fourth FET, wherein a gate electrode and a drain electrode of the first FET are grounded, a source electrode of the first FET is connected with a drain electrode of the third FET, a source electrode of the second FET is connected with a drain electrode of the fourth FET, a drain electrode of the second FET is grounded, a gate electrode of the third FET is connected with a gate electrode of the fourth FET, and both a source electrode of the third FET and a source electrode of the fourth FET are connected with the external power source;

wherein the feedback unit comprises a first resistor, a fifth FET, a sixth FET and a comparator, wherein a first end of the first resistor is grounded, and a second end thereof is connected with a gate electrode of the second FET, an inverting input of the comparator is connected with a source electrode of the second FET and a drain electrode of the fourth FET, a non-inverting input of the comparator is connected with a drain electrode of the third FET and a source electrode of the first FET, a gate electrode and a drain electrode of the fifth FET, a gate electrode of the fourth FET and a drain electrode of the sixth FET are all connected, a source electrode of the fifth FET is connected with the external power source, a gate electrode of the sixth FET is connected with an output terminal of the comparator, and a source electrode of the sixth FET is connected with a gate electrode of the second FET.

2. The circuit for outputting reference voltage, as recited in claim 1, wherein the output unit comprises a seventh FET, a second resistor and an eighth FET, wherein a gate electrode of the seventh FET is connected with a drain electrode and a gate electrode of the fifth FET and a drain electrode of the sixth FET, a source electrode of the seventh FET is connected with the external power source, a drain electrode of the seventh FET is connected with a first end of the second resistor and the external output terminal, a second end of the second resistor is connected with a source electrode of the eighth FET, and both a drain electrode and a gate electrode of the eighth FET are grounded.

3. The circuit for outputting reference voltage, as recited in claim 2, wherein the first FET, the second FET and the eighth FET have the same channel-length and the same threshold voltage.

4. The circuit for outputting reference voltage, as recited in claim 2, wherein the first FET and the second FET have the same channel-width, and a channel-width of eighth FET is k times thereof the first FET or the second FET, wherein k is a positive integer.

5. The circuit for outputting reference voltage, as recited in claim 2, wherein the fourth FET, the fifth FET and the seventh FET have the same breadth length ratio, a breadth length ratio of the third FET is twice as much as thereof the fourth FET, the fifth FET or the seventh FET.

6. The circuit for outputting reference voltage, as recited in claim 2, wherein the first FET, the second FET, the third FET, the fourth FET, the fifth FET, the seventh FET and the eighth FET all have the same electron mobility and gate oxide capacitance per unit area.

* * * * *